US006163991A

United States Patent [19]

Drapcho et al.

[11] Patent Number: 6,163,991

[45] Date of Patent: Dec. 26, 2000

[54] MACHINE-FOLDABLE DISPLAY HAVING SUPERIMPOSED, SPACED-APART IMAGE PANELS

[75] Inventors: Joseph E. Drapcho; Gregory M. Proulx, both of Waconia, Minn.

[73] Assignee: SpringLeaf Concepts & Design, Inc., Waconia, Minn.

[21] Appl. No.: 09/234,941

[22] Filed: Jan. 21, 1999

Related U.S. Application Data

[63] Continuation-in-part of application No. 09/162,427, filed as application No. PCT/US97/04909, Mar. 28, 1997, abandoned, and application No. 08/625,575, Mar. 28, 1996, Pat. No. 5,778,578.

[51] Int. Cl.[7] ..... G09F 1/00

[52] U.S. Cl. ..... 40/124.09; 40/124.14; 283/117

[58] Field of Search ..... 40/124.09, 124.14, 40/539, 743, 788, 789; 283/117; 428/9, 12; 446/147

[56] References Cited

U.S. PATENT DOCUMENTS

| | | | |
|---|---|---|---|
| 2,203,578 | 6/1940 | Podmore | 40/124.09 |
| 2,546,878 | 3/1951 | Townley | 40/539 X |
| 2,586,071 | 2/1952 | Manen-Mayol | 40/539 X |
| 4,084,015 | 4/1978 | Patterson | 40/539 X |
| 4,462,178 | 7/1984 | Freeman | 40/124.09 X |
| 4,854,060 | 8/1989 | Corbo et al. | 40/539 X |
| 4,885,859 | 12/1989 | Gasser | 40/539 |
| 5,116,648 | 5/1992 | Martin et al. | 40/539 X |
| 5,778,578 | 7/1998 | Drapcho et al. | 40/124.01 |

*Primary Examiner*—Brian K. Green
*Attorney, Agent, or Firm*—Larry M. Jennings, P.A.

[57] ABSTRACT

A display is described that can be formed from a single sheet of card stock or other planar material. The display can be used as a greeting card, a photograph frame, a desk decoration, an award, a seasonal ornament that can be hung from a hook or loop and for other purposes. Spaced-apart, superimposed image panels are hinged or folded to spacers. The panels have apertures that define pictorial elements in profile. The spaced-apart panels may be placed in alignment and view in elevation to reveal a scene having substantial dimensionality. A different scene can be revealed when the display is made of unprinted plain card stock. It is possible, however, to print or emboss the display or to make it using colored papers. It is a particular advantage that the display can be manufactured in a continuous machine process using conventional stock-handling equipment. Another important feature of the article is that it can be stored or shipped flat and expanded when viewing is desired. Yet another advantage of the article is that it provides an object that may be used as a greeting card, and then be displayed over an extended period of time.

18 Claims, 8 Drawing Sheets

MACHINE-FOLDABLE DISPLAY HAVING SUPERIMPOSED, SPACED-APART IMAGE PANELS

REFERENCE TO CO-PENDING APPLICATION

This application is a continuation-in-part of our co-pending application Ser. No. 09/162,427, filed Sep. 28, 1998, which application is a continuation-in-part of International Application Serial No. PCT/US97/04909 (now abandoned), filed on Mar. 28, 1997, which International Application was based on the priority document, U.S. patent application Ser. No. 08/625,575, filed Mar. 28, 1996, now U.S. Patent No. 5,778,578.

FIELD OF THE INVENTION

The present invention relates to the field of ornamental displays such as may be used with greeting cards, photograph holders, seasonal decorations that may be set on horizontal surfaces or suspended from objects such as window frames, doorways, or Christmas trees, and the like. More specifically, an embodiment of the present invention relates to the field of three-dimensional scenes formed by superimposed cut-out panels. The present invention relates to a machine-foldable display of images formed by a plurality of spaced-apart image panels made of planar or sheet materials through which apertures are formed to create images in silhouette or profile, in particular. Greeting cards, especially those characterized as "surprise," "pop-up," "pop-out," "pull-tab," "interactive," or "reveal" cards (some of them quite elaborate), are among the familiar applications for displays with features that may be observed to change in response to manipulation by the viewer or recipient. Displays with changeable observable features may also be incorporated into folders, books, advertisements, brochures, promotional articles, novelties, games, toys, amusements, and the like, as well as in other useful articles.

Articles within the field of the present invention are often made of a folded material, although other techniques of fabrication can readily be used without departing from the invention. Low cost, as well as workability with existing methods and equipment, make paper a favored material for embodiments of the present disclosure. Natural or synthetic sheet materials other than paper, such as metals, plastics, textiles, or wood, may also be used to embody the present invention. These and other materials may provide utilitarian, aesthetic or manufacturing advantages.

Machine-foldable displays with superimposed, spaced-apart image panels can often be printed, scored, die-cut, folded, glued, assembled and packaged using conventional stock handling machinery, presses, cutters, folders, and techniques. It is believed preferable to manufacture articles according to this disclosure by machine. It must, however, be appreciated that any of the cutting, printing, gluing, hinging, folding, assembling, packaging, operating, or other manufacturing steps may be performed manually. Practicing the methods according to this disclosure will enable articles to be produced more quickly with less material and less waste than is possible using only the techniques known previously. Enhanced productivity and efficiency are available to those who practice the present invention whether the products are fabricated manually or by machine.

It is possible to render designs, illustrations, writings, and other works of authorship according to the articles and methods shown here to create and provide greeting cards, gifts, awards, and mementos having much greater sophistication and delightfulness than do conventional greeting cards and articles for comparable purposes. It is anticipated that articles according to this disclosure will be used to display, among other things, photographs, announcements, mementos, citations, etc.

BACKGROUND OF THE INVENTION

Displays with features that are changeable in response to the actions of an observer and methods for their manufacture have long been the subject of inventive effort. The usual purpose for making an interactive display is to provide an article having greater sensory appeal than would be created by a non-changeable display. Indeed, a folded greeting card is often designed to deliver an image or text upon being opened that is surprising, humorous, or contrasting when viewed subsequent to the message on the front of the card. Other cards may have a die-cut aperture that enables the person viewing the card to see part or all of an image that is presented on the interior panel. Still other cards may include structures that unfold and expand to create three dimensional forms or scenes.

Substantial creative effort has been directed to developing sophisticated "pop-up" cards, some of which have several components that are cut and folded precisely before being fitted together and glued to the main portion of the card. The assembly precision required to make a pop-up feature operate as intended is a distinct disadvantage. A card with several components that must be cut, folded, interconnected, and affixed to a substrate is certain to require more labor than a product made from a single piece of stock. Compared to a conventional, book-folded card, each of the additional steps required to make a pop-up card is an operation that creates additional losses due to component damage, out-of-tolerance conditions, and increased reject rates. In short, each step in the production process is likely to increase the cost of the finished product, increase the percentage of rejected goods, or both. Although intricate greeting cards and pop-up displays are often quite pleasing, such materials are often intended for display for only a short time. The limited time that such works are displayed imposes a requirement that costs be held as low as possible while still making goods of the desired quality because failure to do so could result in goods that are simply too expensive to be marketed.

Generally, displays with superimposed, spaced-apart image panels, including the present invention, are fabricated from paper; however, any sheet material can be used to make such displays, including, without limitation, vinyl, polyethylene, other polymers, resins, resin-coated paper, treated paper, leather, parchment, foil, leaf, laminae, textile, metal, and wood materials. Displays with superimposed, spaced-apart image panels in the field of the present invention often are purposefully designed to allow them to be mailed readily. Upon opening the display, the recipient may be presented with animation, a changing message, a surprise image, or a dimensionality that is unavailable in conventional greeting cards and similar goods.

Displays of great variety have been used as greeting cards, advertising materials, toys, and the like. Two types of active elements are most commonly used to effect display change: either the "pop-up/pop-out" type or else the "slide/pull-out" type. Many examples of pop-up displays are known, including the fanciful Greeting Card described by Schrager in U.S. Pat. No. 4,763,427. Crowell's Bent Resilient Leaf Spring Pop-up Display Assemblies shown in U.S. Pat. No. 4,774,780 teaches a self-erecting pop-up stationery display that is comprised of a parallelogram or "Z-shaped" resilient leaf spring element bonded to a greeting card or other display medium.

Penick, et al. disclose Pop-ups and Methods of Making in U.S. Pat. No. 4,349,973, but the pop-up element requires the addition of adhesive both in the fabrication of the pop-up portion and also to affix the pop-up element to the card.

In U.S. Pat. No. 4,586,279, for example, Hopkins discloses a Folding Display Assembly that a person can activate to cause animation. The Hopkins apparatus allows a panel that has images of eyes and mouth to move behind a humorous illustration of a humorous face that has cut-outs through which the moving eyes and mouth may be viewed.

Likewise, U.S. Pat. No. 3,946,508 issued to Booras for a Scene-changing Display Card comprised a windowed envelope surrounding a sliding element. A deflectable lower portion of the apparatus is affixed to the sliding element with adhesive. When the lower portion is deflected, the portion of the sliding element that is normally exposed by the envelope window moves out of observation and a different, normally concealed, section of the slide is revealed through the window.

A Folding Card is disclosed by Gasser in U.S. Pat. No. 4,885,859, issued Dec. 12, 1989. Gasser shows a series of windows of decreasing size that are intended to draw the attention of the observer to an advertising slogan printed on the surface exposed by the smallest of the windows. Gasser also forms the folding card from a multiplicity of components. Five pieces of cut sheet material are used to form the simpler of two embodiments Gasser discloses in the patent drawings.

It is also to be noted that many of the earlier devices require cutting complex shapes from the sheet material which makes the manufacture of the display more difficult. For example, the Booras device and the Hopkins device both require an "L" shaped sheet as the starting material. Although other shapes can be used satisfactorily, the starting material for the present invention is preferably rectangular and the cutting needed is generally straight and quite simple, which can reduce material, set-up, tooling, production and re-work costs compared to the displays known in the art.

SUMMARY OF THE INVENTION

Although considerable effort has been expended in the field of displays with changeable observable features, interactively operable greeting cards, holiday scenes, and ornamentation, the efforts have, until now, failed to produce a display of sufficient intricacy and potentially diverse modes of implementation to stimulate people's fascination while, at the same time, being susceptible of manufacture at a relatively modest cost.

The present invention is a machine-foldable display having superimposed, spaced-apart image panels that can be made from a single sheet. Although numerous displays have been presented by other workers in the field, it is believed that no other display has provided similar detail, dimensionality, and simplicity in a one-piece, die-cut article.

In making an embodiment according to the present disclosure, an elongated sheet may be scored with transverse fold scores that define a first spacer having a glue surface, a first image panel, a second spacer, a second image panel, a third spacer, a third image panel, a fourth spacer having a glue surface, an optional outer front flap, and an optional inner front flap. After the fold lines have been scored, image outlines, or profiles, may be die-cut into the first, second, and third panels. The sheet may be folded at the third score line (intermediate the second spacer and the second panel) to bring the first spacer into contact with the third spacer to which it may be affixed. The sheet may be folded a second time to bring the second spacer into contact with the fourth spacer and affixing it thereto. If an optional front flap is included, the interior face of the inner front flap panel may be folded to contact the interior face of the outer front flap panel. The front flap may then be folded over the image panels to complete the article.

To view the article, the observer may open any optional front flap, and then orient the spacers perpendicular to the panels, thereby spacing the panels apart.

It is to be understood that additional spacers and panels may be included without any specific limitation as to their number. It is further to be understood that the front flap may be comprised of additional panels that can include photograph-holding slits or envelope-forming panels.

This uniquely effective design yields several advantages. First, the visual image may be die-cut from opaque, translucent, semi-transparent, or transparent sheet, or from materials treated to alter the optical properties of selected portions of the material. Second, the material remaining after the die cuts have been made can create visual impressions of interest and depth. Third, the sheet can be treated by printing, coloring, laminating, embossing, dying, coating, or with other treatments before it is folded. Fourth, because the die-cut process removes material, it is possible to form a scene with superimposed image panels that may be enjoyably viewed from either the front or from the back. Fifth, the first and second sides of the image panels may be made with very different optical properties. A flat finish could be desired on one side of a panel and a highly reflective finish could be applied to the opposite side of the same panel to obtain novel visual effects. This disclosure enables the manufacture, at modest cost, of attractive displays that are likely to be viewed and appreciated for a longer period of time than would similar articles made according to previously known methods and designs.

For example, an embodiment of this disclosure could be configured with a front flap and used as a greeting card. If the front flap is fitted with slits for receiving a photograph, the recipient may mount a photograph to the inner side of the front flap thereby using the card as a photograph mount. It may be desirable to have a perforated front flap that could be easily removed so as to allow the article to be hung from a Christmas tree or in a window. The article could also be designed for use as an ornament exclusively.

This display offers advantages over previous articles and methods even for applications in which longer useful life of the product is not particularly important, such as in advertising or editorial materials included with printed publications. The present machine-foldable display having superimposed, spaced-apart image panels is easily fabricated from a single piece of foldable sheet material, such as paper. Embodiments of the invention may also be fabricated from materials such as metals, plastics, foils, laminated materials, composites, wood, textiles, leather, minerals, rubber, other sheet materials, and any other materials or combinations of materials that may be formed into a sheet or panel. If it is desired to make an embodiment of the invention from material that is either not foldable or which will not retain a fold, separate hinge elements may optionally be provided. When an embodiment is made from card stock, it is possible to make hinges by scoring the stock and folding it on the score lines. For the sake of simplicity and the purposes of this disclosure, the folds of a folded embodiment are deemed equivalent to hinges.

Low production costs may be realized because the design is easily fabricated using existing machinery.

DETAILED DESCRIPTION OF THE INVENTION

The present invention as well as its objects and advantages can be illustrated by describing the fabrication, structural elements, characteristics and functional elements of the preferred embodiments as shown in the attached drawings.

Figure 1:
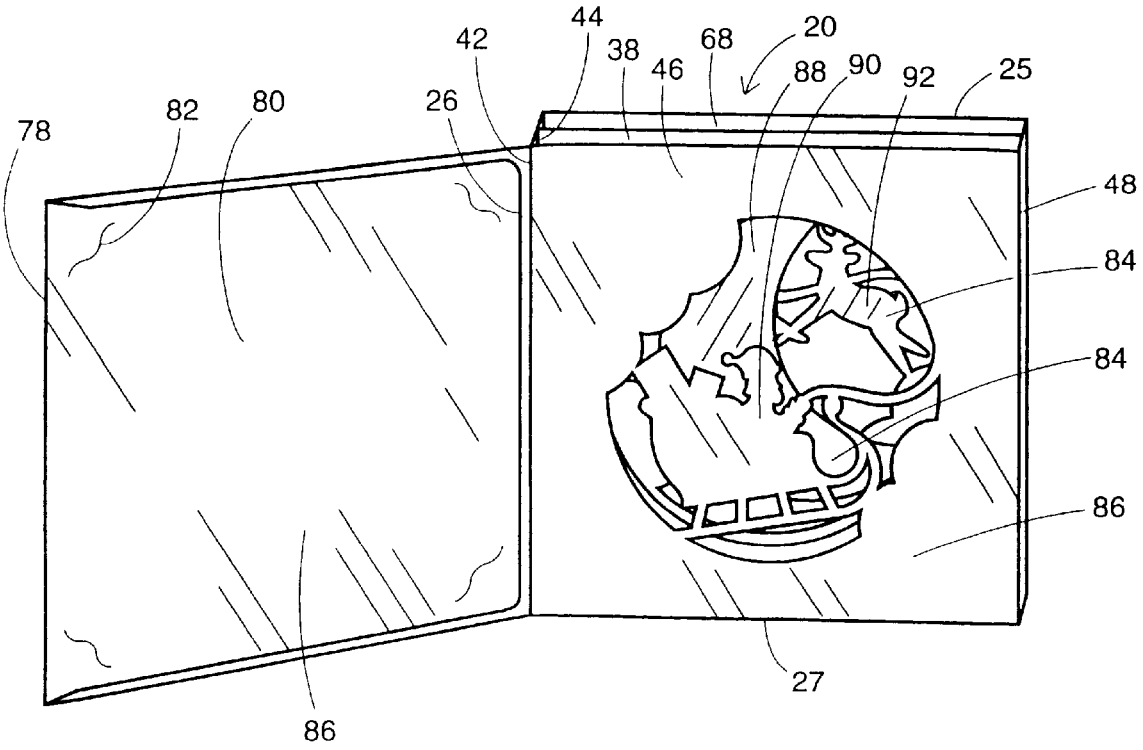
FIG. 1 is a perspective view of an embodiment of a machine-foldable display having superimposed image panels.
Figure 11:
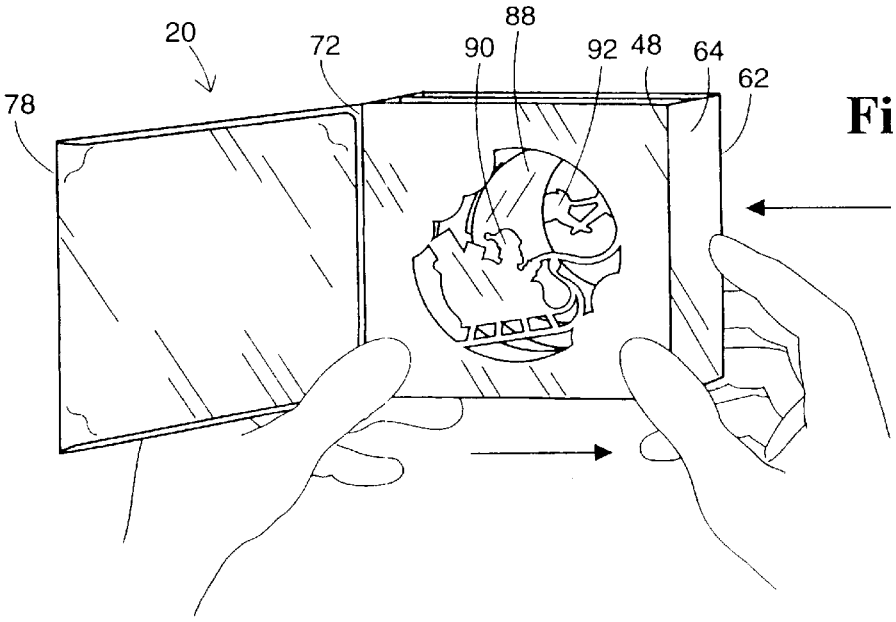
FIG. 11 is a view of the embodiment of the invention shown in FIG. 10, from the perspective of an observer slightly above the elevation of the article wherein the observer has opened the front flap and manipulated the spacers partially toward perpendicular to the image panels.
Figure 12:
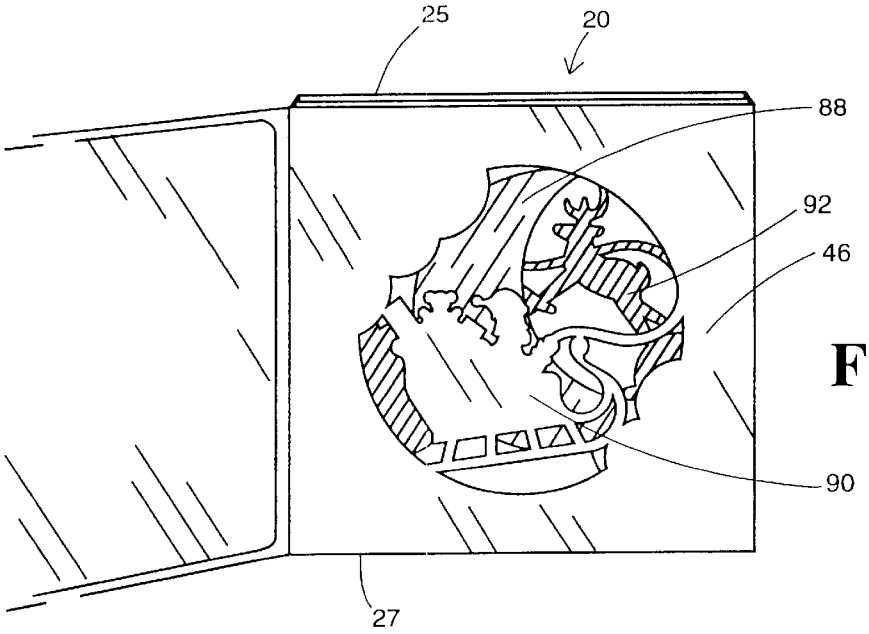
FIG. 12 is a front elevation view of the embodiment shown in FIG. 11, wherein the spacers have been oriented perpendicular to the image panels.
Figure 13:
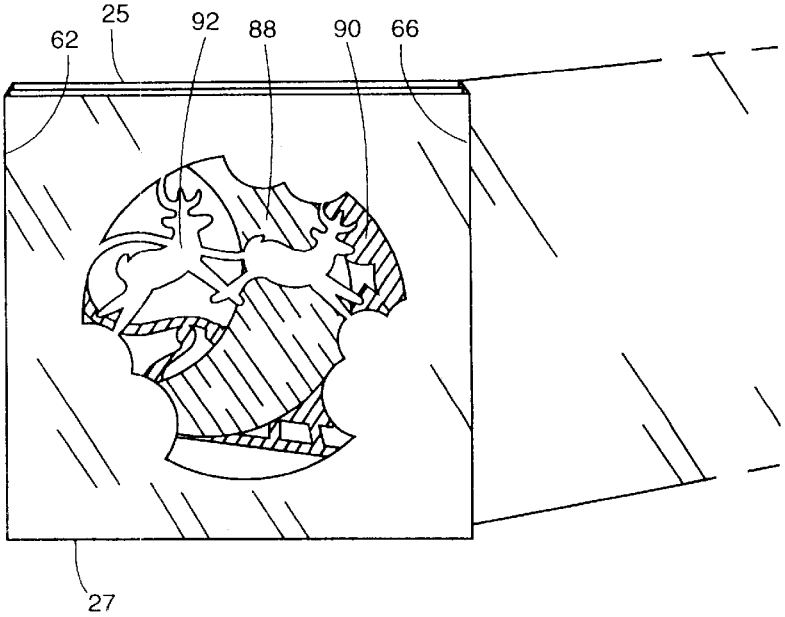
FIG. 13 is a back elevation view of the embodiment shown in FIG. 12.
Figure 14:
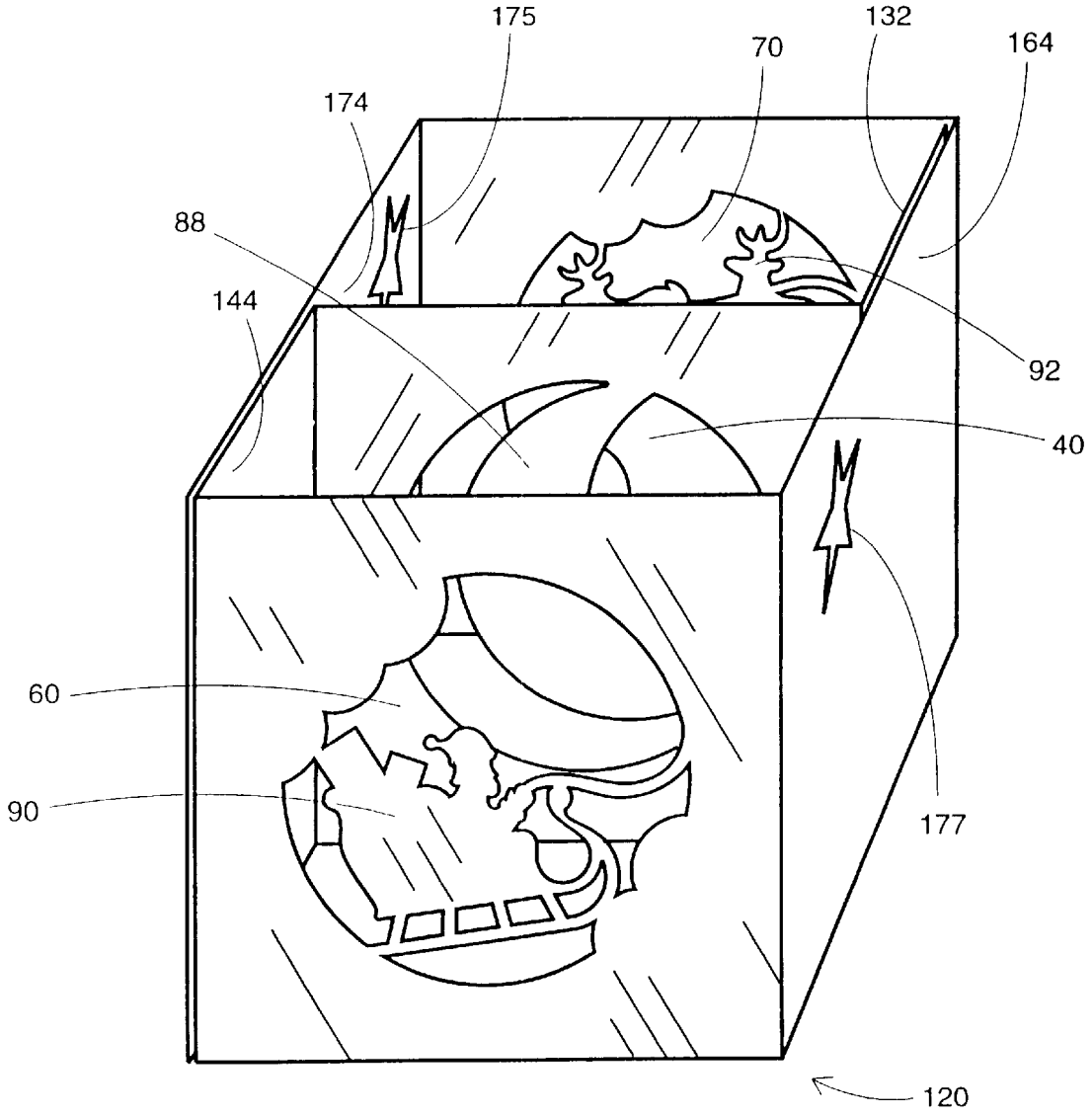
FIG. 14 is an alternative embodiment of the machine-foldable display having superimposed, spaced-apart image panels in which the image panels are spaced farther apart than are the image panels of the embodiment depicted in FIG. 1.

Referring to the drawings, and initially to FIG. 1, an embodiment of a machine-foldable display having superimposed, spaced-apart image panels 20 is shown in perspective from slightly above the article. A method of fabricating the, embodiment depicted in FIG. 1 is described following and the steps of the method are shown in FIG. 2 through FIG. 10. The method of operating the display 20 is shown in FIG. 11 through FIG. 13. An alternative embodiment is shown in FIG. 14.

Figure 2:
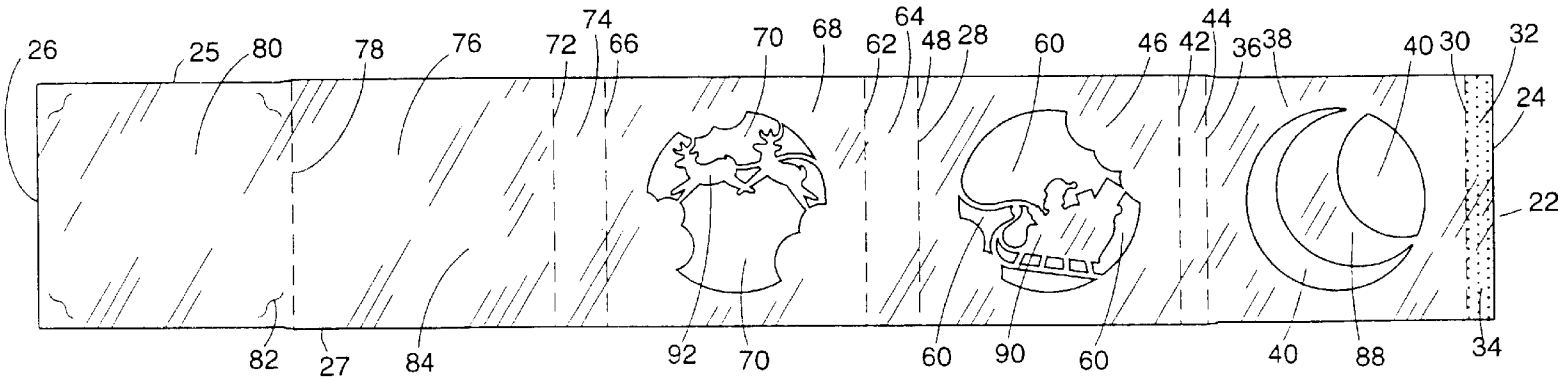
FIG. 2 is an elevation view of the cut-out sheet material blank from which one embodiment of the machine-foldable display having superimposed, spaced-apart image panels is constructed, the first side bearing surface indicia angled from the lower left to the upper right.

Referring now to FIG. 2, a method of fabricating the machine-foldable display having superimposed, spaced-apart, image panels 20 is disclosed. A sheet 22 of any foldable planar material, including, without limitation, paper, metal, wood, leather, plastic film, cloth, fiberglass, textiles, polymer resins, and composite materials may be used to make the display 20. Although not essential to the invention, it is anticipated that most embodiments will be fabricated from a sheet 22 that is elongated, having a first end edge 24, the length of which is shorter than the length of the top edge 25. A second end 26 is located opposite the first end 24 with both the top edge 25 and an opposed bottom edge 27 communicating between the two ends. Although the sheet 22 is shown as rectangular, it is to be understood that embodiments of this disclosure made from sheets having other shapes are deemed equivalent and can be made without departing from the scope of the invention defined in the appended claims. For the sake of clarity, and for the convenience of the reader, the method will be described according to the rectangular shape of the sheet 22 depicted in the various figures.

A typical score line 28 is used to prepare the sheet to fold in the manner of a hinge. It would be possible to replace the various score lines 28 and corresponding folds that are to be made at those locations with hinges which are equivalent for the purposes of this disclosure. The score lines 28 define the various regions of the sheet 22.

A score line 28 would normally be formed at the location of each fold; for example, a first fold 30 extends transversely across the sheet 22 parallel to the first end 24. The portion of the sheet 22 between the first end 24 and the first fold 30 comprises a first spacer portion 32 to which may be attached a first fastener 34 of any type adapted to the materials of the sheet 22 and the uses for which the display 20 is intended. In some instances, the fastener 34 may be inherent in the sheet 22; heat sealable materials may, for example, be used to form the spacer and no additional fastener would be needed. In other instances, the fastener 34 might be an adhesive. In still other cases, clips, staples, wire, thread, or the like might be used as the fastener 34.

Spaced-apart from the first fold 30 is the second fold 36 with the intervening space comprising a first image panel 38. First panel image-forming apertures 40 may be die-cut, laser-cut, or cut by other manual or mechanical means. It is possible to have the apertures 40 cut before, after, or simultaneously with the scoring of the sheet 22. A third fold 42 is made parallel to the second fold 36 to define a second spacer 44. The second spacer 44 may be made approximately the same size as the first spacer 32 by making the separation between the second fold 36 and the third fold 42 approximately the same as the separation between the first end 24 and the first fold 30.

A second image panel 46 is formed by the portion of the sheet 22 between the third fold 42 and the fourth fold 48. By making the distance between third fold 42 and the fourth fold 48 approximately the same as the distance between the first fold 30 and the second fold 36, the second image panel 46 will be approximately the same size as the first image panel 38. Second image panel 46 image-forming apertures 60 may be die-cut, laser-cut, or cut by other manual or mechanical means through the planar material comprising the sheet 22.

A fifth fold 62 may be spaced-apart from the fourth fold 48 by a distance approximately twice the distance that separates the first fold 30 from the first end 24. The third spacer 64, being formed by the portion of the sheet 22 situated between the fourth fold 48 and the fifth fold 62, is about twice the length of the first spacer 32 and second spacer 44.

A sixth fold 66 is spaced parallel to, and apart from, the fifth fold 62 to form a third image panel 68 that is approximately the same size as the first image panel 38 and the second image panel 46. Image- forming apertures 70 may optionally be formed through the third image panel 68 by die-cutting, laser-cutting, or cut by other alternative methods including, without limitation, water jet cutting, air jet cutting, shearing, sawing, punching, piercing, tearing, perforating, and other manual or mechanical means.

Alternatively, the third image panel 68 may be left uncut to form a background for the images formed by the first panel image-forming apertures 40 and second panel image-forming apertures 60. In another alternative embodiment, the second image panel 46 may be fabricated without cutting image-forming apertures 60 so as to serve as a background for images formed by the first image panel 38 and the third image panel 68.

It is to be understood that an embodiment according to this disclosure is not limited to three image panels 38 46 68. It is possible to include an indefinite number of image panels. It is also possible to form embodiments in which one image panel is replaced by a solid background panel.

An optional seventh fold 72 may be made in the sheet 22 between a fourth spacer 74 and an optional front flap outside panel 76. If a front flap is incorporated into the display 20, it may be comprised of a front flap outside panel 76 alone, or it may include an optional eighth fold 78 and optional front flap inside panel 80. When the design of an embodiment of the display 20 includes an inside front flap 80, it will be possible also to include planar object-retaining slits 82. The planar object-retaining slits 82 can hold a variety of items including, without limitation, photographs, awards, commendations, prizes, certificates, poems, prints, texts, and other information.

An aperture 83 may be formed through the front flap inside panel 80 or the front flap outside panel 76. In such an embodiment, the slits could hold a picture between the two flap faces for viewing through the aperture. It would be possible, likewise, to cover the aperture with a planar object fitted into the slits for viewing so as to view the planar object without the framing effect of the aperture.

It is to be appreciated that the inside front flap 80 could be optionally used as a back flap simply by making the fold at the fold line 78 the last fold in the production process.

When an embodiment that does not include a front flap is desired, the second end 26 of the sheet 22 would be situated at the location denominated as the optional seventh fold 72.

Figure 3:
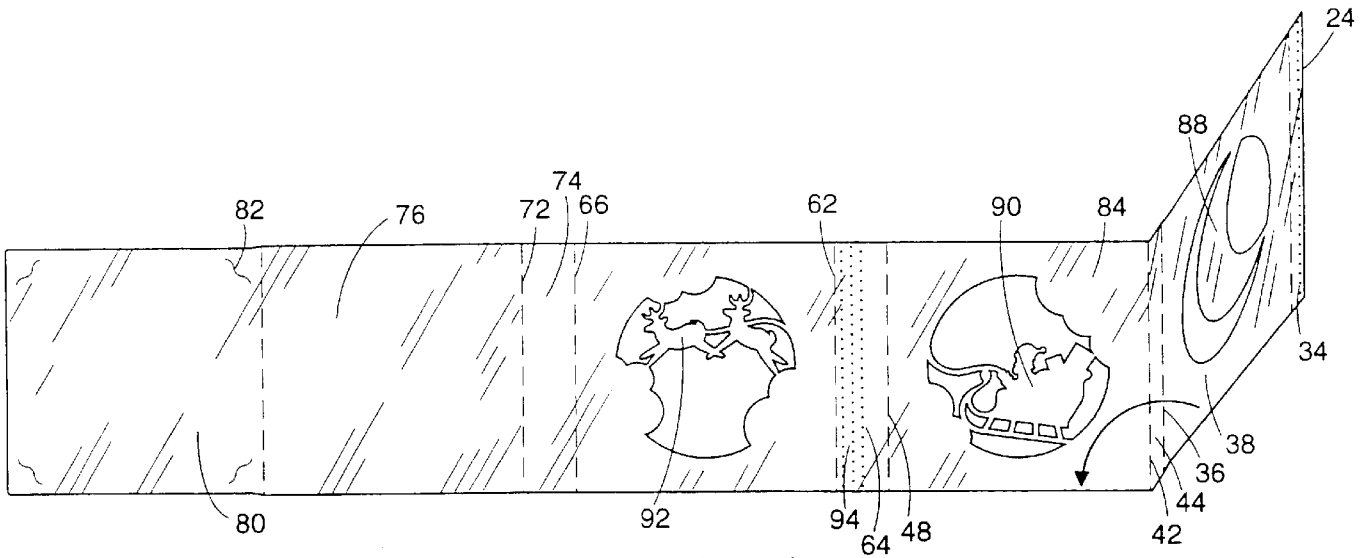
FIG. 3 is a view of the blank of FIG. 2 from a perspective of slightly below the elevation of the sheet wherein the first fold is partially folded toward the viewer.

Viewing now FIG. 3, the steps in formation of the scored and die-cut, laser-cut, or alternatively-cut, elongated sheet 22 into a three dimensional display 20 as depicted in FIG. 1 will be shown. The perspective of FIG. 3 is as though the sheet 22 is positioned on the top surface of a table, in front of the viewer who is seated near the sheet 22. As shown in FIG. 3, the first side 84 of the sheet is toward the viewer.

The sheet 22 could be scored at the fold lines 30 36 42 48 62 66 72 78 to facilitate subsequent folding. The sheet 22 could be folded next at the third fold 42 to bring the first side 84 of the first image panel 38 into adjoining contact with the first side of the second image panel 46. Simultaneously, the first side 84 of the first spacer 32 is brought into contact with the portion of the third spacer 64 adjacent the fifth fold 62.

Figure 4:
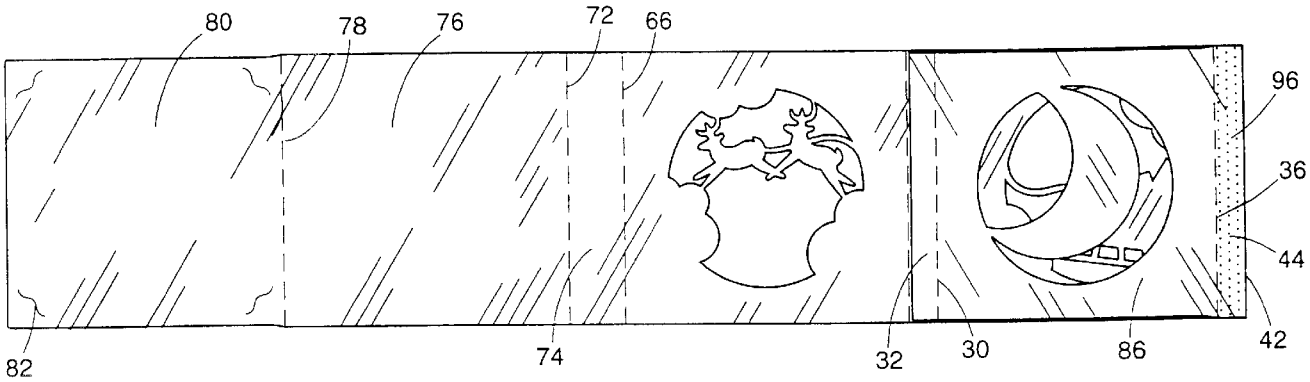
FIG. 4 is a view of the partially folded blank shown in FIG. 3 wherein the first fold is completed.

In FIG. 4, the second side 86 of the sheet 22 is revealed. A first panel image-forming portion 88, defined by the first panel image-forming apertures 40 is superimposed over the second panel image-forming portion 90 which is visible through the first panel image-forming apertures 40. The first panel 38 is shown offset toward the second end 26 by an amount equal to the length of the first spacer 32.

The third panel 68, likewise, has a third panel image-forming portion 92 defined by the third image panel 68 image-forming apertures 70. A first fastener attachment surface 94 is the half of the third fold 64 adjacent the third panel 68. The second fastener 96 is at the second side 84 of the second spacer 44.

Figure 5:
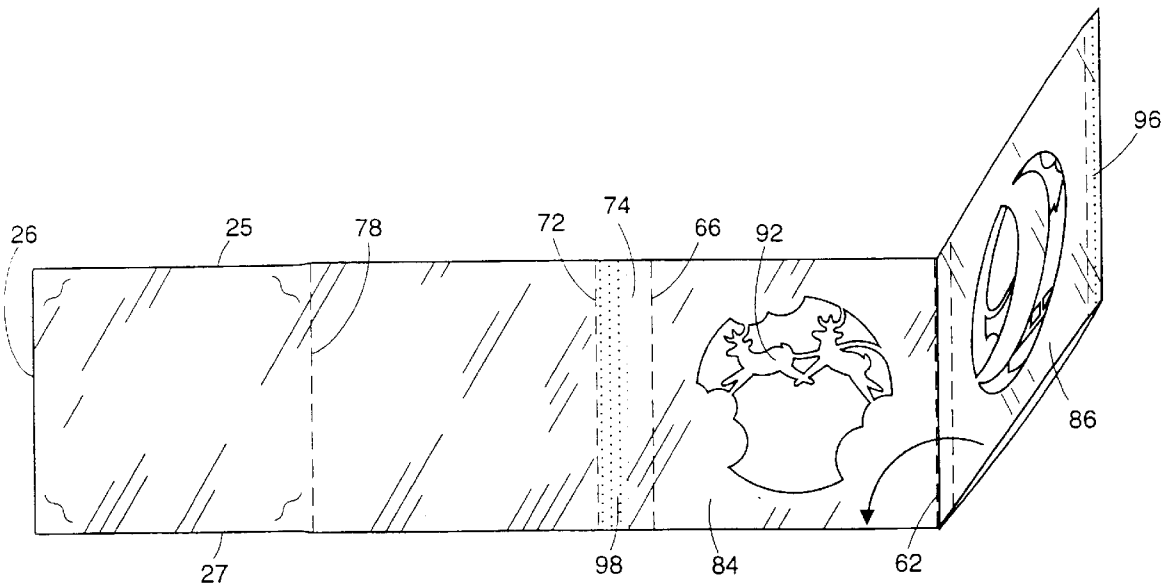
FIG. 5 is a view of the partially folded blank shown in FIG. 4 wherein the second fold is partially folded toward the viewer.

In FIG. 5, the second side 86 of the first panel 38 is brought into adjoining contact with the first side 84 of the third panel 68 by folding the sheet 22 at the fifth fold 62. In so doing, the second fastener 96 is brought into contact with the half of the fourth spacer 74 adjacent the optional front flap outside panel 76.

Figure 6:
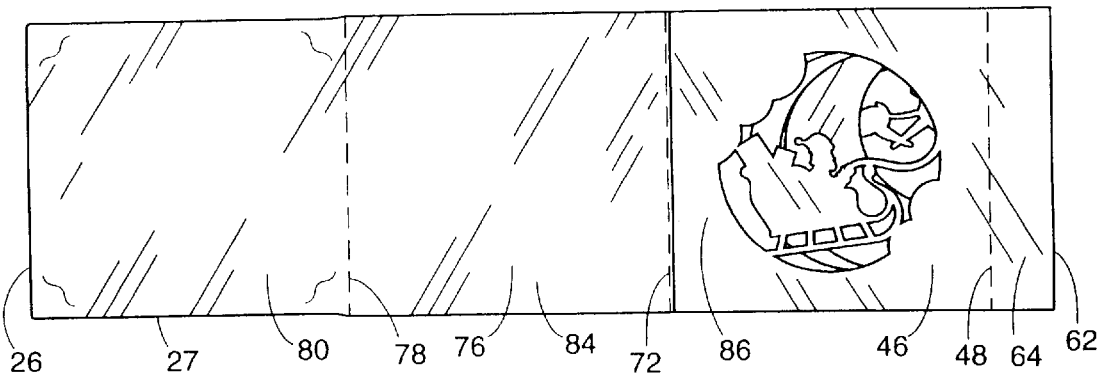
FIG. 6 is a view of the partially folded blank shown in FIG. 5 wherein the second fold is completed.

In FIG. 6 the second fastener 96 has been connected to the second fastener attachment surface 98 and the image-forming portions of the first panel 88 and second panel 90 are superimposed over the image-forming portions of the third panel 92. The first panel 38 is offset from the third panel 68 toward the second end 26 at fold 42 by the length of the third 64 and fourth 74 spacers. The second panel 46 is offset toward the second end 26 from the third panel 68 by only the length of the first spacer 32 and second spacer 44.

Figure 7:
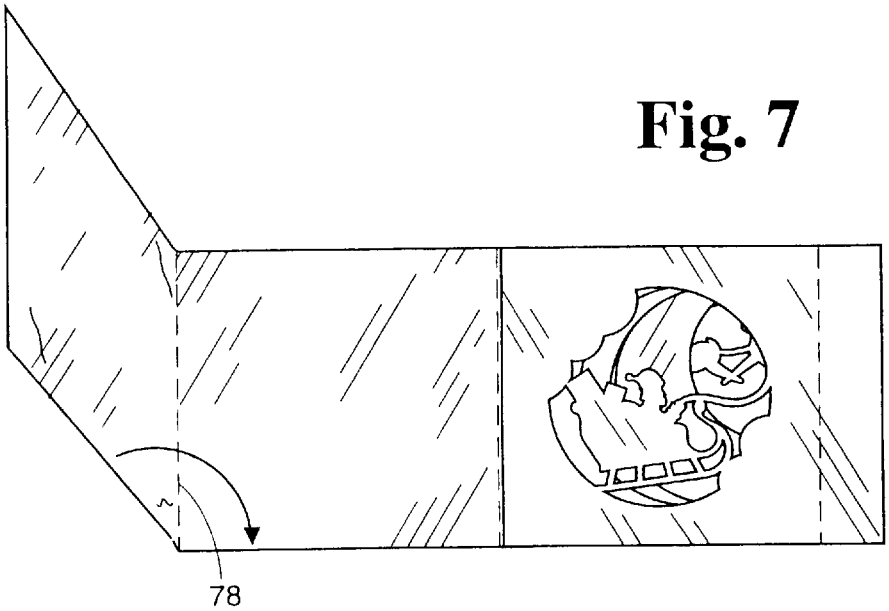
FIG. 7 is a view of the partially folded blank shown in FIG. 6 wherein the front flap-forming fold is partially folded toward the viewer.

In FIG. 7, the optional front flap inside panel 80 is being folded at fold 78 to bring their first surfaces 84 into contact.

Figure 8:
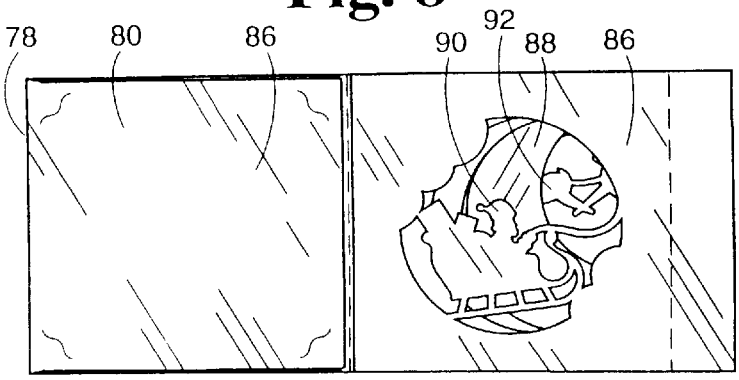
FIG. 8 is a view of the partially folded blank shown in FIG. 7 wherein the front flap-forming fold is completed.

In FIG. 8, the second surface 86 of the optional front flap inside portion 80 is shown adjacent the second surface 86 of the second image panel 46.

Figure 9:
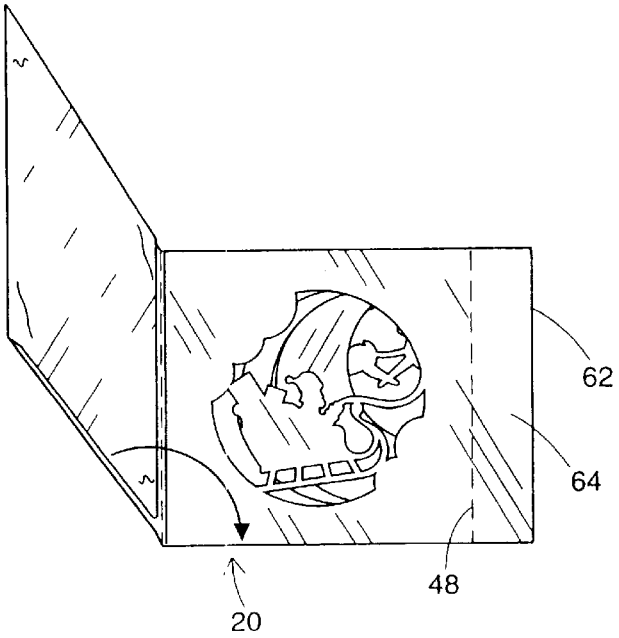
FIG. 9 is a view of the partially folded blank shown in FIG. 8 wherein the front flap is folded partially closed.

FIG. 9 shows the optional front flap inside panel 80 folding toward the second surface 86 of the second image panel 46.

Figure 10:
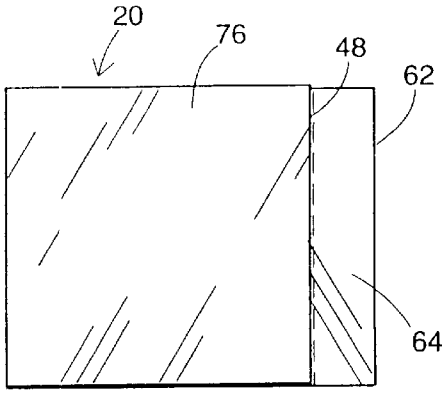
FIG. 10 is a view of the folded blank shown in FIG. 9 wherein the front flap is folded closed.

FIG. 10 shows the display 20 in a fully closed and flattened configuration. In this position, it could be placed into an envelope for mailing.

It is also possible to form an envelope from the sheet 22 integrally with the display 20 by lengthening the front flap outside panel 76 and the front flap inside panel 80 by an amount equal to the length of the third spacer 64 and fourth spacer 74. The first surface 84 of the front flap inside panel 80, could be folded to bring it into adjacent contact with the second surface 86 of the third image panel 68. The addition of a simple gummed or mechanical closure near the second end 26 would complete the formation of the display 20 self envelope.

The configuration of the display 20 shown in FIG. 10 has, at the thickest point, six layers of the material comprising the sheet 22. Even if made from heavy stock, the thickness might not exceed ⅛ inch.

FIG. 11 shows the display 20 being expanded for viewing. The third spacer 64 is being brought perpendicular to the image panels. The action removes the offset from the panel positions and brings the first image panel 40, second image panel 46, and third image panel 68 into superimposed alignment.

FIG. 12 shows the fully expanded display 20 in front elevation. The first side of the sheet 84 is visible at the first panel image-forming portion 88 and the third panel image-forming portion 92. The second side of the sheet 86 is exposed on the second panel image-forming portion. The spacer 64 might be one inch which would create a display having a distance between the second image panel 46 and the third image panel 68 of one inch.

FIG. 13 shows the rear elevation of the fully expanded display 20 which reveals the second side 86 of the first panel image-forming portion 88 and third panel image-forming portion 92 and the first side 84 of the second panel image-forming portion 90.

FIG. 14 shows an alternative embodiment of the machine-foldable display having superimposed, spaced-apart image panels 120. The spacing between the first image panel 38 and the second image panel 46 has been changed by the use of an alternative first spacer 132 and an alternative second spacer 144. An alternative third spacer 164 and an alternative fourth spacer 174 creates an alternative spacing between the second image panel 46 and the third image panel 68. In addition, the alternative spacers 132, 144, 164, 174 may be fitted with one or more optional spacer apertures 175. It would also be possible to fit a spacer with other, additional optional features 177 that may be images applied to a surface or apertures through one or more of the alternative spacers 132, 144, 164, 174.

Figure 15:
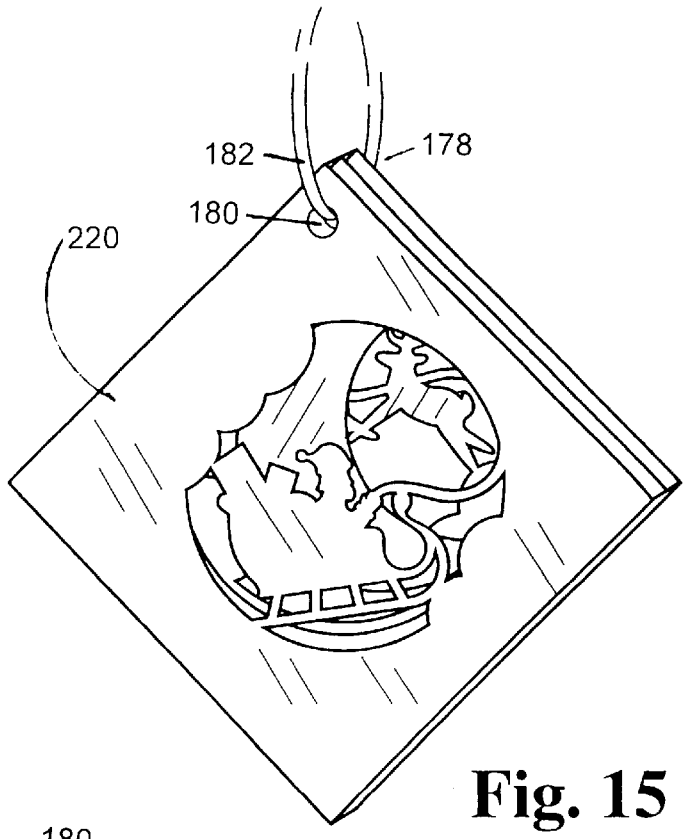
FIG. 15 is a second alternative embodiment that has a diamond shape.

FIG. 15 shows an alternative embodiment 220 that is intended to be displayed in the form of a diamond rather than the square form of the previously illustrated embodiment of the machine-foldable display having superimposed, spaced-apart, image panels 20. An optional front flap 76 is not included in the embodiment depicted in FIG. 15 because the scene depicted is not ideally suited for display at both the diamond and the square configuration. Other images might be formed that could be displayed with the top and bottom of the embodiment horizontal or at a 45 degree angle from horizontal.

Figure 16:
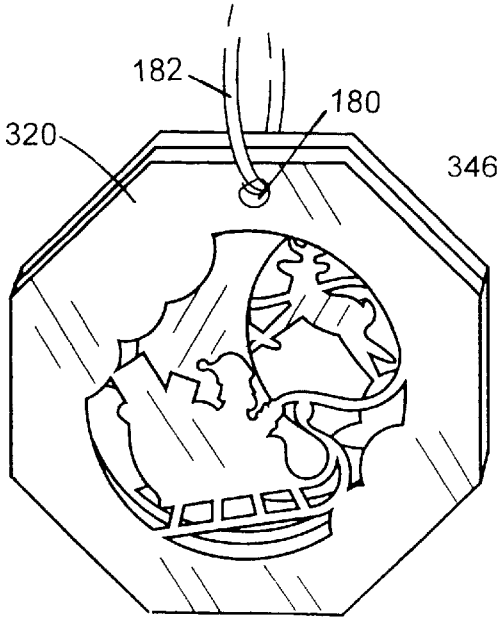
FIG. 16 is a third alternative embodiment that has an octagonal shape.
Figure 17:
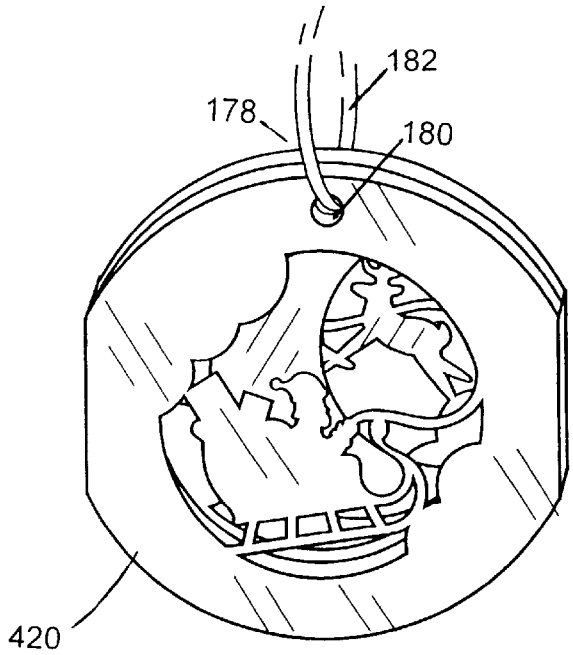
FIG. 17 is a fourth alternative embodiment that has an oval shape.

FIG. 16 is a third alternative embodiment of the machine-foldable display 320. Like the embodiment presented in FIG. 15, the foldable display 320 in FIG. 16 has some means for hanging 178 that may be comprised of one or more attachment apertures 180 by which an embodiment may be fitted onto a support object such as a nail or picture hangar. The hangar 178 may be further comprised of additional hangar elements 182 including, without limitation, thread, string, ring, band, hook, wire, ribbon, tape, adhesive tape, adhesives, pins, and other such structures and compositions of matter that may, or may not, cooperate with any attachment apertures 180 to yield a functional means for hanging 178 the embodiment. By way of example only, the additional hanging element 182 depicted in FIG. 15, FIG. 16, and FIG. 17 is a ring. It is to be understood that the means for hanging may be installed through a single attachment aperture 180 formed through the second panel 346.

FIG. 17 depicts a fourth alternative embodiment of the machine-foldable display 420 that has an oval, but generally circular, outline. These and other alternative embodiments are specifically within the scope of the invention taught by the present disclosure. It is likely that it would be necessary to cut the apertures and the curves or angled portions of the various embodiments before the step of folding the panels and spacers. It might be possible to cut the octagonal corner of FIG. 16 or the oval of FIG. 17 after the folding step using water jet or laser. The image-forming apertures must be cut, however, before the sheet can be folded, so it might be more practical to cut all of the apertures and shapes at the same time.

It is to be further understood that two sets of image panels could be formed in a single sheet 22, with one set being formed beginning at opposite ends of the sheet 22.

Changes and modifications in the specifically described embodiments can be carried out without departing from the scope of the invention which is intended to be limited only by the scope of the appended claims.

DRAWING INDICIA DESCRIPTIONS

| | |
|---|---|
| 20 | machine-foldable display having superimposed, spaced-apart image panels |
| 22 | sheet |
| 24 | first end |
| 25 | top |
| 26 | second end |
| 27 | bottom |
| 28 | typical score line |
| 30 | first fold |
| 32 | first spacer portion |
| 34 | first fastener |
| 36 | second fold |
| 38 | first image panel |
| 40 | first panel image-forming apertures |
| 42 | third fold |
| 44 | second spacer |
| 46 | second image panel |
| 48 | fourth fold |
| 60 | second panel image-forming apertures |
| 62 | fifth fold |
| 64 | third spacer |
| 66 | sixth fold |
| 68 | third image pane |
| 70 | third panel image-forming apertures |
| 72 | optional seventh fold |
| 74 | fourth spacer |
| 76 | front flap outside panel |
| 78 | eighth fold |
| 80 | front flap inside panel |
| 82 | slits for retaining planar object |
| 84 | first side of sheet |
| 86 | second side of sheet |
| 88 | first panel image-forming portion |
| 90 | second panel image-forming portion |
| 92 | third panel image-forming portion |
| 94 | first fastener attachment surface |
| 96 | second fastener |
| 98 | second fastener attachment surface |
| 120 | alternative embodiment of the machine-foldable display having superimposed, spaced-apart image panels |
| 132 | alternative first spacer |
| 144 | alternative second spacer |
| 164 | alternative third spacer |
| 174 | alternative fourth spacer |
| 175 | optional spacer aperture |
| 177 | additional optional |

-continued

| DRAWING INDICIA DESCRIPTIONS | |
|---|---|
| | features |
| 178 | means for hanging |
| 180 | attachment apertures |
| 182 | additional hangar elements |
| 220 | second alternative embodiment of the machine-foldable display having superimposed, spaced-apart image panels |
| 320 | third alternative embodiment of the machine-foldable display having superimposed, spaced-apart image panels |
| 346 | alternative second panel |
| 420 | fourth alternative embodiment of the machine-foldable display having superimposed, spaced-apart image panels |

That which is claimed is:

1. A machine-foldable display having superimposed, spaced-apart image panels comprising:

a. an elongated sheet having a first side and a second side, a first end and a second end, an elongated top edge generally parallel to an elongated bottom edge, the sheet being scored with a multiplicity of generally parallel transverse fold scores oriented generally perpendicular to the top and bottom edges that define:

i) a first spacer having a first fastener, the first spacer being situated between, and adjacent to, the first end and a first fold;

ii) a first image panel situated between and adjacent to the first fold and a second fold;

iii) a second spacer having a second fastener, the second spacer being situated between the second fold and a third fold;

iv) a second image panel situated between and adjacent to the third fold and a fourth fold;

v) a third spacer having a first fastener attachment surface for matingly receiving the first fastener, the third spacer being situated between and adjacent to the fourth fold and a fifth fold;

vi) a third image panel situated between and adjacent to the fifth fold and a sixth fold;

vii) a fourth spacer having a second fastener attachment surface at which the second fastener is affixed, the fourth spacer being situated adjacent to the sixth fold opposite the third image panel;

b. a first set of image-forming apertures extending through the first image panel;

c. a second set of image-forming apertures extending through the second image panel in alignment with the first set of image-forming apertures, and;

d. a third set of image-forming apertures extending through the third image panel in alignment with the first set and the second set of image-forming apertures.

2. The machine-foldable display having superimposed, spaced-apart image panels defined in claim 1 wherein the fasteners are comprised of an adhesive.

3. The machine-foldable display having superimposed, spaced-apart image panels defined in claim 2 wherein a portion of the sheet is embossed.

4. The machine-foldable display having superimposed, spaced-apart image panels defined in claim 1 wherein a seventh fold is situated between the fourth spacer and a front flap outside panel.

5. The machine-foldable display having superimposed, spaced-apart image panels defined in claim 4 wherein an eighth fold is situated between the front flap outside panel and a front flap inside panel having slots for receiving a photograph.

6. The machine-foldable display having superimposed, spaced-apart image panels defined in claim 5 wherein the fasteners are comprised of an adhesive.

7. The machine-foldable display having superimposed, spaced-apart image panels defined in claim 4 wherein the fasteners are comprised of an adhesive.

8. The machine-foldable display having superimposed, spaced-apart image panels defined in claim 1 wherein a portion of the sheet is embossed.

9. The machine-foldable display having superimposed, spaced-apart image panels defined in claim 1 wherein the sheet is further comprised of a means for hanging.

10. A machine-foldable display having superimposed, spaced-apart image panels comprising:

a. an elongated sheet having a first side and a second side, a first end and a second end, an elongated top edge generally parallel to an elongated bottom edge, the sheet being scored with a multiplicity of generally parallel transverse fold scores oriented generally perpendicular to the top and bottom edges that define:

i) a first spacer having a first fastener on the first side of the sheet, the first spacer being situated between, and adjacent to, the first end and a first fold;

ii) a first image panel situated between, and adjacent to, the first fold and a second fold;

iii) a second spacer having a second fastener on the second side of the sheet, the second spacer being situated between, and adjacent to, the second fold and a third fold;

iv) a second image panel situated between, and adjacent to, the third fold and a fourth fold;

v) a third spacer having a first fastener attachment surface on the first side of the sheet at which the first fastener is affixed, the third spacer being situated between, and adjacent to, the fourth fold and a fifth fold;

vi) a third image panel situated between and adjacent to the fifth fold and a sixth fold;

vii) a fourth spacer having a second fastener attachment surface on the first side of the sheet at which the second fastener is affixed, the fourth spacer being situated between, and adjacent to, the sixth fold and a seventh fold with the second fastener attachment surface adjacent the seventh fold;

b. a first set of image-forming apertures extending through the first image panel;

c. a second set of image-forming apertures extending through the second image panel in alignment with the first set of image-forming apertures, and;

d. a third set of image-forming apertures extending through the third image panel in alignment with the first set and the second set of image-forming apertures.

11. The machine-foldable display having superimposed, spaced-apart image panels defined in claim 10 wherein the fastener used to affix the spacers is an adhesive.

12. The machine-foldable display having superimposed, spaced-apart image panels defined in claim 10 wherein a seventh fold is situated between the fourth spacer and a front flap outside panel.

13. The machine-foldable display having superimposed, spaced-apart image panels defined in claim 12 wherein an eighth fold is situated between the front flap outside panel and a front flap inside panel.

14. The machine-foldable display having superimposed, spaced-apart image panels defined in claim 13 wherein the fastener is an adhesive.

15. The machine-foldable display having superimposed, spaced-apart image panels defined in claim 14 wherein a portion of the sheet is embossed.

16. The machine-foldable display having superimposed, spaced-apart image panels defined in claim 13 wherein the front flap inside panel is provided with slots for receiving a photograph.

17. The machine-foldable display having superimposed, spaced-apart image panels defined in claim 16 wherein a portion of the sheet is embossed.

18. The machine-foldable display having superimposed, spaced-apart image panels defined in claim 10 wherein the sheet is further comprised of a means for hanging.

* * * * *